US012371768B2

(12) United States Patent
Arsene et al.

(10) Patent No.: US 12,371,768 B2
(45) Date of Patent: Jul. 29, 2025

(54) ALUMINUM ALLOY PRECISION PLATES

(71) Applicants: CONSTELLIUM ISSOIRE, Issoire (FR); Constellium Valais SA, Sierre (CH)

(72) Inventors: Sylvie Arsene, Voreppe (FR); Petar Ratchev, Voiron (FR); Nicolas Calabretto, Veyras (CH); Christophe Jaquerod, Noes (CH)

(73) Assignees: CONSTELLIUM ISSOIRE, Issoire (FR); CONSTELLIUM VALAIS SA (LTD), Sierre (FR)

( * ) Notice: Subject to any disclaimer, the term of this patent is extended or adjusted under 35 U.S.C. 154(b) by 113 days.

(21) Appl. No.: 17/765,345

(22) PCT Filed: Sep. 29, 2020

(86) PCT No.: PCT/FR2020/051704
§ 371 (c)(1),
(2) Date: Mar. 30, 2022

(87) PCT Pub. No.: WO2021/064320
PCT Pub. Date: Apr. 8, 2021

(65) Prior Publication Data

US 2022/0389557 A1 Dec. 8, 2022

(30) Foreign Application Priority Data

Oct. 4, 2019 (FR) ..... 1911024

(51) Int. Cl.
*C22F 1/043* (2006.01)
*C22C 21/02* (2006.01)

(52) U.S. Cl.
CPC ..... *C22F 1/043* (2013.01); *C22C 21/02* (2013.01)

(58) Field of Classification Search
CPC ..... C22C 21/00; C22C 21/02; C22C 21/06; C22C 21/04; C22C 21/08
See application file for complete search history.

(56) References Cited

U.S. PATENT DOCUMENTS

| | | | | |
|---|---|---|---|---|
| 5,776,269 | A * | 7/1998 | Farrar, Jr. | C22C 21/003 148/439 |
| 2005/0095167 | A1 | 5/2005 | Barth et al. | |
| 2010/0018617 | A1 | 1/2010 | Wada et al. | |
| 2015/0255253 | A1 | 9/2015 | Van Kappel et al. | |
| 2021/0017631 | A1 | 1/2021 | Da Fonseca Barbatti et al. | |
| 2021/0130933 | A1 | 5/2021 | Delgrange et al. | |

FOREIGN PATENT DOCUMENTS

| | | | |
|---|---|---|---|
| CN | 108239712 | A | 7/2018 |
| CN | 108239713 | A | 7/2018 |
| EP | 2263811 | A1 | 12/2010 |
| JP | H03287738 | A | 12/1991 |
| WO | 03054243 | A1 | 7/2003 |
| WO | 2014060660 | A1 | 4/2014 |
| WO | 2017207603 | A1 | 12/2017 |
| WO | 2018162823 | A1 | 9/2018 |
| WO | 2019122076 | A1 | 6/2019 |

OTHER PUBLICATIONS

Tanner et al., Modelling stress reduction techniques of cold compression and stretching in wrought aluminum alloy products, Elsevier, Finite Elements in Analysis and Design 39 (2003) 369-386. (Year: 2003).*
PCT International Search Report for PCT/FR2020/051704, mailed Jan. 21, 2021, 4 pages.

* cited by examiner

*Primary Examiner* — Adam Krupicka
(74) *Attorney, Agent, or Firm* — McBee Moore & Vanik IP, LLC

(57) ABSTRACT

The present invention relates to plates with a thickness of between 8 and 50 mm and made from aluminum alloy with a composition, as % by weight, Si: 0.7-1.3; Mg: 0.6-1.2; Mn: 0.65-1.0; Fe: 0.05-0.35; at least one element selected from Cr: 0.1-0.3 and Zr: 0.06-0.15; Ti<0.15; Cu<0.4; Zn<0.1; other elements <0.05 each and <0.15 in total, the remainder aluminum, and the method for manufacturing same. The plates according to the invention are particularly useful as precision plates, in particular for producing elements of machines, for example assembly or inspection equipment. The plates according to the invention have improved dimensional stability in particular during the machining steps, while having sufficient static mechanical properties, and excellent suitability for anodizing.

15 Claims, 3 Drawing Sheets

[Fig. 1]

[Fig. 2]
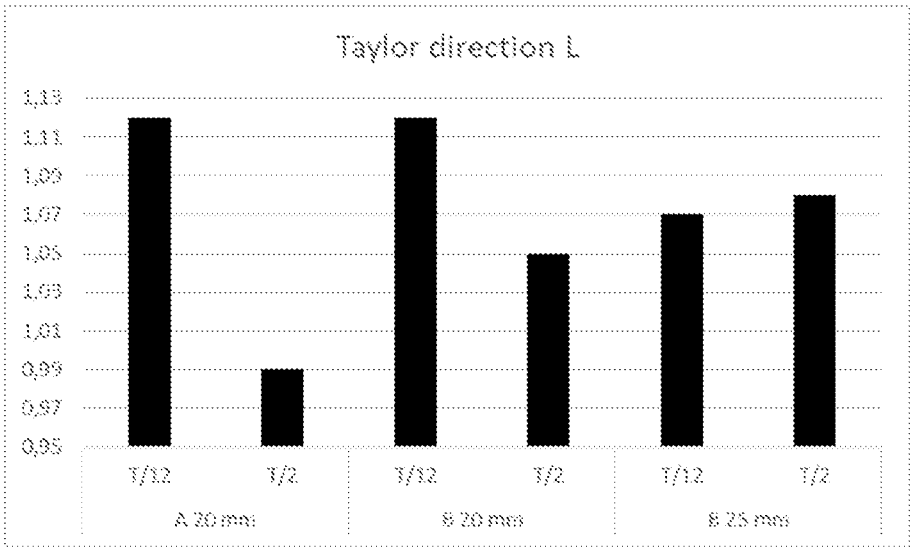

ALUMINUM ALLOY PRECISION PLATES

CROSS-REFERENCE TO RELATED APPLICATIONS

This application is the National Stage entry of International Application No. PCT/FR2020/051704, filed 29 Sep. 2020, which claims priority to French Application No. 1911024, filed 4 Oct. 2019.

BACKGROUND

Field

The invention relates to plates made from aluminum alloy in the 6xxx series, in particular intended to be used as precision slabs.

Description of Related Art

Excellent dimensional stability is very important for applications using precision plates, the thickness of which is typically between 8 and 150 mm. This type of product is typically used for producing machine elements, in particular as reference sheets for assembly or inspection equipment. For these applications, it is particularly important to reduce as far as possible any deformation of the plate during machining thereof, which makes it possible to avoid additional operations of premachining or final retouching.

The patent application EP2263811 relates to rolled products the surface of which is machined having a flatness of 0.2 mm or less. According to one embodiment of this patent application, the alloy contains 0.3 to 1.5% by mass Mg, 0.2 to 1.6% by mass Si, and in addition one or more elements selected from the group consisting of 0.8% by mass or less Fe, 1.0% by mass or less Cu, 0.6% by mass or less Mn, 0.5% by mass or less Cr, 0.4% by mass or less Zn, and 0.1% by mass or less Ti, the remainder being Al and unavoidable impurities.

The patent application WO2014/060660 relates to a vacuum-chamber element obtained by machining and surface treating a plate with a thickness of at least 10 mm made from aluminum alloy with a composition, as % by weight, Si: 0.4-0.7; Mg: 0.4-0.7; Ti 0.01-<0.15, Fe<0.25; Cu<0.04; Mn<0.4; Cr 0.01-<0.1; Zn<0.04; other elements <0.05 each and <0.15 in total, the remainder aluminum.

The patent application WO2018/162823 relates to a vacuum-chamber element obtained by machining and surface treating a plate with a thickness of at least 10 mm made from aluminum alloy with a composition, as % by weight, Si: 0.4-0.7; Mg: 0.4-1.0; the ratio as a % by weight Mg/Si being less than 1.8; Ti: 0.01-0.15; Fe: 0.08-0.25; Cu<0.35; Mn<0.4; Cr: <0.25; Zn<0.04; other elements <0.05 each and <0.15 in total, the remainder aluminum, characterized in that the grain size of said plate is such that the mean linear-interception length measured in the L/TC plane in accordance with ASTM E112, is at least 350/μm between surface and ½ thickness.

The patent application US2010018617 discloses an aluminum alloy for anodic oxidation treatment that comprises, as alloy elements, 0.1 to 2.0% Mg, 0.1 to 2.0% Si and 0.1 to 2.0% Mn, each Fe, Cr and Cu content being limited to 0.03 mass % or less, and in which the rest is composed of Al and unavoidable impurities. This application teaches in particular a homogenizing treatment at a temperature above 550° C. and below or equal to 600° C.

The patent application CN108239712 relates to a sheet made from 6082 aluminum alloy for aviation and a method for manufacturing same. The chemical components of the sheet of 6082 aluminum alloy comprise, as a percentage by weight, 1.0% to 1.3% Si, 0.1% to 0.3% Fe, 0.05% to 0.10% Cu, 0.5% to 0.8% Mn, 0.6% to 0.9% Mg, 0.06% to 0.12% Zn, no more than 0.05% Cr, no more than 0.05% Ti and the remainder Al and unavoidable elements.

The patent application CN108239713 relates to an aluminum alloy sheet for an electronic product and a method for manufacturing the aluminum alloy sheet. The chemical components of the aluminum alloy sheet for the appearance of the electronic component comprise, as a percentage by weight, 0.3% to 0.4% Si, no more than 0.10% Fe, no more than 0.05% Cu, no more than 0.05% Mn, 0.45% to 0.55% Mg, no more than 0.05% Zn, no more than 0.05% Cr, no more than 0.05% Ti and the remainder Al and unavoidable elements.

Alloys in the 6XXX family are moreover known for forging.

The patent application WO2017/207603 discloses a forged blank made from hot-laminated semi-fabricated aluminum alloy in the 6xxx series having a thickness in the range from 2 mm to 30 mm, and having a composition comprising, by weight. %, Si 0.65-1.4%, Mg 0.60-0.95%, Mn 0.40-0.80%, Cu 0.04-0.28%, Fe up to 0.5%, Cr up to 0.18%, Zr up to 0.20%, Ti up to 0.15%, Zn up to 0.25%, impurities each <0.05%, total <0.2%, balance aluminum, and wherein it has a substantially non-recrystallized microstructure. The application also relates to a method for manufacturing such a forging material made from hot-laminated aluminum alloy in the 6xxx series. The method for manufacturing the forged blank does not comprise stress relieving and dimensional stability during machining is not a criterion for this type of product intended to be greatly deformed hot by forging.

The patent application US2005/095167 discloses a component or a semi-fabricated part fabricated from an aluminum alloy hot formed, typically by forging, with the following composition by weight. %: silicon 0.9-1.3, magnesium 0.7-1.2, manganese 0.5-1.0, copper less than 0.1, iron less than 0.5, chromium less than 0.25, titanium less than 0.1, zinc less than 0.2, zirconium and/or hafnium 0.05-0.2 and other unavoidable impurities, the total quantity of chromium and manganese and zirconium and/or hafnium being at least 0.4 by weight, mixed aluminum/silicon crystals being present in addition to the magnesium silicide precipitates. Once again the method for manufacturing the forged blank does not comprise stress relieving and dimensional stability during machining is not a criterion for this type of product intended to be greatly deformed hot by forging.

There exists a need for improved plates of aluminum alloy in the 6XXX series, in particular precision plates, having improved dimensional stability in particular during the machining steps, while having sufficient static mechanical properties, and excellent suitability for anodization.

SUMMARY

A first object of the invention is a method for manufacturing an aluminum alloy plate with a final thickness of between 8 and 50 mm, wherein a) a rolling ingot is cast from aluminum alloy with the composition, as % by weight, Si: 0.7-1.3; Mg: 0.6-1.2; Mn: 0.65-1.0; Fe: 0.05-0.35; at least one element selected from Cr: 0.1-0.3 and Zr: 0.06-0.15; Ti<0.15;

Cu<0.4; Zn<0.1; other elements <0.05 each and <0.15 in total, the remainder aluminum, b) said rolling ingot is homogenized, c) said rolling ingot is rolled at a temperature of at least 340° C. to obtain a plate with a thickness of at least 12 mm, d) optionally heat treatment and/or cold rolling of the plate thus obtained is carried out, e) a solution heat treatment of the plate, optionally heat treated and/or cold rolled, is carried out, and it is quenched, f) said plate thus solution heat treated and quenched is stress-relieved by controlled stretching with a permanent elongation of 1 to 5%, g) aging of the plate thus stretched is carried out, h) optionally said plate thus aged is machined to obtain a plate with a final thickness of at least 8 mm.

A second object of the invention is a plate with a thickness of between 8 and 50 mm made from aluminum alloy with a composition, as % by weight, Si: 0.7-1.3; Mg: 0.6-1.2; Mn: 0.65-1.0; Fe: 0.05-0.35; at least one element selected from Cr: 0.1-0.3 and Zr: 0.06-0.15; Ti<0.15; Cu<0.4; Zn<0.1; other elements <0.05 each and <0.15 in total, the remainder aluminum, able to be obtained by the method according to the invention.

Another object of the invention is the use of a plate according to the invention as a precision plate, in particular for producing elements of machines, for example assembly or inspection equipment.

BRIEF DESCRIPTION OF THE DRAWINGS

FIG. 2 shows the Taylor factor in the longitudinal direction measured at $1/12^{th}$ of the thickness and ½ thickness for plates made from alloy A and B with a final thickness of 20 mm and 25 mm.

DETAILED DESCRIPTION OF A PREFERRED EMBODIMENT

Figure 1A:
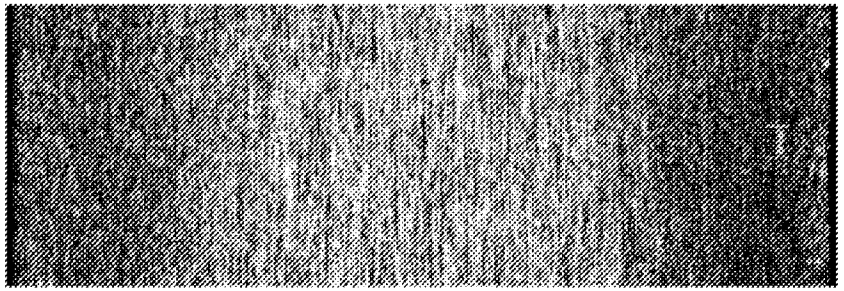
FIG. 1 shows the granular structure in cross section @L/TC after hot rolling to the thickness of 25 mm of the product made from alloy A (FIG. 1*a*) and of the product made from alloy B (FIG. 1*b*).

The alloys are designated in conformity with the rules of the Aluminum Association (AA), known to a person skilled in the art. The definitions of the metallurgical states are indicated in the European standard EN 515. Unless mentioned to the contrary, the definitions of EN12258-1 apply.

Unless mentioned to the contrary the compositions are expressed as % by weight.

Unless mentioned to the contrary, the static mechanical characteristics, in other words the ultimate tensile strength $R_m$, the conventional yield strength at 0.2% elongation $R_{p0.2}$ and the elongation at rupture A %, are determined by a tensile test in accordance with ISO 6892-1, the sampling and the direction of the test being defined by EN 485-1.

According to the invention, the improved plates made from aluminum alloy in the 6XXX series, in particular precision plates, have improved dimensional stability in particular during machining steps, while having sufficient static mechanical properties, and excellent suitability for anodization, are obtained by means of selecting a composition as % by weight, Si: 0.7-1.3; Mg: 0.6-1.2; Mn: 0.65-1.0; Fe: 0.05-0.35; at least one element selected from Cr: 0.1-0.3 and Zr: 0.06-0.15; Ti<0.15; Cu<0.4; Zn<0.1; other elements <0.05 each and <0.15 in total, the remainder aluminum, and by means of the method according to the invention.

The composition according to the invention makes it possible in particular to obtain low deformation during the machining of the products. Without being bound by a theory, the present inventors think that the composition according to the invention makes it possible to obtain an essentially non-recrystallized structure throughout the thickness after hot rolling, which surprisingly makes it possible, after solution heat treatment and quenching, stress relieving and aging, to obtain a product having very low internal stresses and therefore deforming little during machining.

The present inventors have found in particular that, compared with a standard composition of the AA6082 alloy, the present of a large quantity of Mn and of at least one element selected from Cr and Zr makes it possible to improve the properties.

Thus the Mn content is between 0.65 and 1.0% by weight. Preferably, the minimum Mn content is 0.70%, advantageously 0.75% and preferentially 0.80% or even 0.85%. Preferably the maximum Mn content is 0.95%. In one embodiment of the invention, the Mn content is between 0.8 and 1.0% by weight.

For similar reasons, the presence of at least one anti-recrystallizing element selected from Cr: 0.1-0.3% and Zr: 0.06-0.15% is necessary. Cr is the preferred anti-recrystallizing element in the context of the invention. Preferably, the minimum Cr content is 0.12%, advantageously 0.15% and preferentially 0.18%. Preferably, the maximum Cr content is 0.28%, advantageously 0.25% and preferentially 0.23%. In one embodiment of the invention, the Cr content is between 0.15 and 0.25% by weight and the Zr content is less than 0.05% by weight. If Zr is added alone or in combination with Cr, the preferred content is 0.08-0.13%.

Adding Fe is also necessary. Thus the Fe content is between 0.05 and 0.35% by weight. Preferably, the minimum Fe content is 0.06%, advantageously 0.07% and preferentially 0.08%. Preferably, the maximum Fe content is 0.30%, advantageously 0.25% and preferentially 0.15%, which can contribute in particular to obtaining the advantageous essentially non-recrystallized granular structure after hot rolling. In one embodiment of the invention, the Fe content is between 0.08 and 0.15% by weight.

Mg and Si are added to achieve the required mechanical characteristics by virtue of the formation of $Mg_2Si$.

The Mg content is between 0.6 and 1.2% by weight. Preferably, the minimum Mg content is 0.61%, advantageously 0.62% and preferentially 0.63%. Preferably, the maximum Mg content is 1.1%, advantageously 1.0% and preferentially 0.9% or even 0.8%. In one embodiment of the invention, the Mg content is between 0.6 and 0.8% by weight.

The Si content is between 0.7 and 1.3% by weight. Preferably, the minimum Si content is 0.72%, advantageously 0.75% and preferentially 0.80%. Preferably, the maximum Si content is 1.2%, advantageously 1.1% and preferentially 1.0% or even 0.95%. In one embodiment of the invention, the Si content is between 0.8 and 1.0% by weight. Preferably, the Si content is greater than the Mg content and preferentially Si/Mg is greater than 1.1 and even more preferentially greater than 1.2 or even 1.3 so as to further reinforce the mechanical characteristics through the presence of silicon phases.

The Ti content is less than 0.15% by weight. It may be advantageous to add Ti, in particular for controlling the grain size during casting. In one embodiment of the invention, the Ti content is between 0.01 and 0.05% by weight.

The Cu content is less than 0.4% by weight. In one embodiment of the invention aimed at obtaining higher mechanical characteristics, Cu is added and the content is between 0.1 and 0.3% by weight. However, in the preferred embodiment, Cu is not added and is present solely by way of unavoidable impurity, its content being less than 0.05% by weight and preferably less than 0.04% by weight so as in particular not to degrade the suitability for anodization.

The Zn content is less than 0.1% by weight. In one embodiment of the invention, Zn is added and the content is between 0.05 and 0.1% by weight. However, in a preferred embodiment, Zn is not added and is present solely by way of unavoidable impurity, its content being less than 0.05% by weight.

The other elements may be present by way of unavoidable impurities with a content of less than 0.05% by weight each and less than 0.15% by weight in total, the remainder is aluminum.

The manufacturing method according to the invention comprises steps of casting, homogenizing, hot rolling, optionally heat treatment and/or cold rolling, solution heat treatment, quenching, stress relieving, aging and optionally machining.

In a first step a rolling ingot is cast from aluminum alloy with a composition according to the invention, preferably by vertical semicontinuous casting with direct cooling. The ingot thus obtained may be scalped, i.e. machined, before the subsequent steps. The rolling ingot is next homogenized. Preferably, the homogenizing temperature is below 550° C. In an advantageous embodiment of the invention the homogenizing temperature is between 515° C. and 545° C. Hot rolling is next implemented to obtain a plate with a thickness of at least 12 mm, either directly after homogenizing or after cooling and reheating to a temperature of at least 340° C., preferably at least 370° C. and preferentially at least 380° C. The hot-rolling temperature is preferably maintained at at least 340° C., preferably at least 350° C. and preferably at least 360° C. or even at least 370° C. The hot-rolling temperature is preferably no more than 450° C. and preferentially no more than 420° C. The exit temperature of the hot rolling is preferably no more than 410° C. and preferably no more than 400° C. When the hot-rolling temperature is too high, the grain size becomes too great, which impairs the dimensional stability during machining. Preferably the maximum rolling mill draft of the passes during hot rolling is less than 50%, preferably less than 45% and preferably less than 40%, or even more preferably less than 35%. In one embodiment of the invention the maximum rolling mill draft of the hot-rolling passes is dependent on the exit thickness of the hot rolling and is less than one hundredth of 1.56 times the thickness−5.9, e.g. for an exit thickness of 25 mm the rolling mill draft of each pass during hot rolling is preferentially less than one hundredth of 1.56 times 25-5.9, i.e. 33.1%. The combination of the composition, the homogenizing and the hot-rolling conditions makes it possible to obtain an essentially non-recrystallized structure, throughout the thickness of the hot-rolled product. Essentially non-recrystallized throughout the thickness means that the degree of recrystallization whatever the position in the thickness is less than 10% and preferably less than 5%.

A heat treatment, making it possible in particular to restore the plate thus hot rolled, may optionally then be implemented, advantageously at a temperature of between 300° and 400° C. A cold rolling, typically of 10 to 50%, may optionally be implemented following the heat treatment or independently.

The plate thus hot rolled and optionally heat treated and/or cold rolled next undergoes a solution heat treatment followed by quenching. The solution heat treatment is preferably implemented at a temperature of between 510° C. and 570° C. The quenching is typically implemented by immersion or spraying of cold water. Next said plate thus solution heat treated and quenched is stress-relieved by controlled stretching with a permanent elongation of 1 to 5%, preferentially of 1.5 to 3%. The stress relieving step is essential for obtaining low internal stresses and therefore stress relieving by controlled stretching is limited to geometries of constant cross section to ensure homogeneous plastic deformation and is therefore not applied to forged products with a complex shape.

Aging is finally implemented, typically at a temperature of between 150° C. and 210° C., to obtain preferably a state T6, T651 or T7.

In one embodiment, said plate thus aged is finally machined to obtain a plate with a final thickness of at least 8 mm. Advantageously at least 1 mm is machined, preferentially at least 1.5 mm or preferably at least 2 mm per face so as to obtain a precision plate.

The plates able to be obtained by the method according to the invention have particularly advantageous properties.

The mechanical properties of the plates according to the invention are particularly advantageous. Preferably, the plates according to the invention have a yield strength $R_{p0.2}$(LT) of at least 240 MPa, preferentially at least 250 MPa and preferably at least 260 MPa, and/or an ultimate tensile strength $R_m$(LT) of at least 280 MPa, preferentially at least 290 MPa and preferably at least 300 MPa and/or an elongation at rupture A % of at least 8%, preferentially at least 10% and preferably at least 12%.

The plates according to the invention have a low level of internal stresses. Thus the product of the maximum deflection difference in the directions L and LT multiplied by the rolling exit thickness is less than 4 and preferably less than 3. The differences in deflections considered for obtaining the value of the maximum deflection difference are firstly the difference in deflection between the deflection measured for a bar with dimensions of 400 mm×30 mm×rolling exit thickness and the deflection measured for this same bar after machining of ¼ of its thickness, and secondly the difference in deflection between the deflection measured for the previous bar, i.e. the bar after machining of ¼ of the thickness with respect to the rolling exit thickness, and the deflection measured for this previous bar after supplementary machining of ¼ of its thickness, all the deflection measurements being made with the bar placed on two supports 390 mm apart and the deflections being expressed in mm, all the measurements being made before the optional final step of machining and in the two directions L and LT.

The texture of the products according to the invention is also advantageous. The crystallographic texture can be described by a mathematical function in three dimensions. This function is known in the art as orientation density function (ODF). It is defined as the volume fraction of the material dV/V having an orientation g to within dg:

$$\frac{dV/V}{dg} = f(g) = f(\varphi_1, \Phi, \varphi_2)$$

where ($\phi 1$, $\Phi$, $\phi 2$) are the Euler angles describing the orientation g.

The ODF of each plate is measured by the spherical harmonics method using four pole figures measured by X-ray diffraction on a traditional texture goniometer. In the context of the invention the measurements of the pole figures were made on samples cut half-way through the plates.

The information contained in the ODF was simplified, as known to a person skilled in the art, in order to describe the texture as a proportion of grains contained in a discretized Euler space. The Taylor factor is a geometric factor that makes it possible to describe the propensity of a crystal to deform plastically by dislocation slip. It takes into account the crystalline orientation as well as the state of deformation imposed on the material. This factor can be seen as a multiplication factor of the yield strength, an important value of the Taylor factor indicating a "hard" grain requiring the activation of numerous slip systems, unlike a low value of the Taylor factor, which will indicate a "soft" grain, easy to deform. For a polycrystalline aggregate, it is possible to calculate a mean Taylor factor, representing the plastic behavior of all the grains. From the texture measurements, the Taylor factor for a given stress direction was calculated in accordance with the method described by Taylor (G.I. Taylor Plastic Strain in Metals, J. Inst. Metals, 62, 307-324; 1938).

Numerous methods derived from the initial Taylor model exist for calculating the Taylor factor and can give substantially different values of Taylor factors. In order to mitigate these differences, the inventors have compared Taylor factor ratios rather than the absolute values.

For the plates according to the invention the ratio between the Taylor factor in the longitudinal direction measured at $1/12^{th}$ of the thickness and ½ of the thickness is between 0.90 and 1.10, preferably between 0.92 and 1.08, and preferably between 0.95 and 1.05, the measurements being made before the optional final machining step.

According to the invention, plates according to the invention are used as precision plate, in particular for producing a reference plate, an inspection tool or a template. This is because the plates according to the invention have improved dimensional stability in particular during the machine steps, while having sufficient static mechanical properties, and excellent suitability for anodizing.

EXAMPLE

In this example, rolling ingots were prepared from an alloy the composition of which is given in Table 1. Alloy A is a reference alloy while alloys B and C are alloys according to the invention.

TABLE 1

Composition of alloys as percentage by weight

| Alloys | Cr | Fe | Mg | Mn | Si | Ti | Zn | Cu |
|---|---|---|---|---|---|---|---|---|
| A | 0.06 | 0.25 | 0.67 | 0.60 | 0.94 | 0.02 | 0.02 | 0.02 |
| B | 0.21 | 0.11 | 0.65 | 0.93 | 0.96 | 0.02 | 0.01 | 0.01 |
| C | 0.20 | 0.10 | 0.67 | 0.87 | 0.92 | 0.02 | 0.00 | 0.00 |

The slabs were homogenized at 535° C. and hot rolled to a thickness of 20 to 35 mm according to circumstances. The hot-rolling entry temperature was between 390 and 410° C., the end of rolling temperature was maintained at a value of at least 340° C. The greatest reduction during a hot-rolling pass, which would correspond to the last pass, is given in Table 2. The plates thus obtained were solution heat treated at 540° C., quenched, stress relieved by controlled stretching and aged to obtain a T651 state. The aging conditions were 8 hours at 165° C. In a last step, a machining of 5 mm (2.5 mm per face) was implemented so that the final thickness was 5 mm less than the end-of-rolling thickness.

The tensile static mechanical characteristics, in other words the ultimate tensile strength Rm, the conventional yield strength at 0.2% elongation Rp0.2, and the elongation at rupture A %, were determined by a tensile test in accordance with NF EN ISO 6892-1 (2016) in the long traverse (LT) direction, the sampling and the direction of the test being defined by EN 485 (2016). The sampling is done before the last machining step. The characterizations were made in the long traverse direction.

The results are given in Table 2

TABLE 2

Static mechanical properties

| Alloys | | Greates reduction during a hot-rolling pass | Final thickness (mm) | Rp0.2 (LT) MPa | Rm (LT) MPa | Ag % | A % |
|---|---|---|---|---|---|---|---|
| A | Y61803 | 44% | 20 | 281 | 326 | 11.3 | 15.3 |
| B | Y61781 | 41% | 20 | 281 | 319 | 8.6 | 15.1 |
| B | Y61779 | 42% | 25 | 285 | 323 | 8.3 | 14.2 |
| B | Y61783 | 38% | 30 | 285 | 326 | 8.6 | 14.9 |
| C | Z65438 | 36% | 25 | 276 | 310 | 8.1 | 14.1 |
| C | Z65439 | 36% | 30 | 277 | 311 | 7.5 | 13.4 |

The residual stresses were evaluated on the plate before machining by measuring the mean deflection on machined bars in the L or LT direction at ¼ and ½ thickness.

Full-thickness bars are sampled, in the L and LT direction, by sawing before the final machining of the plate. The sampling directions are:

for the bar L direction: 430 mm (L direction)×35 mm (LT direction)×thickness for the bar LT direction: 450 mm (LT direction)×35 mm (L direction)×thickness.

The bars are next machined to obtain a bar of length L=400 mm, of width I=30 mm and of thickness e (thickness of the plate). The faces L-LT straight from rolling are not machined so that the thickness of the machined bars remains the thickness of the plate.

Figure 3A:
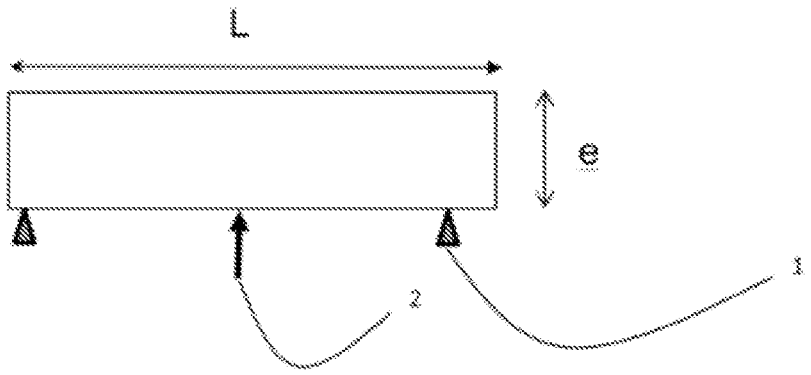
FIG. 3A: initial measurement of deflection of the bar.
Figure 3B:
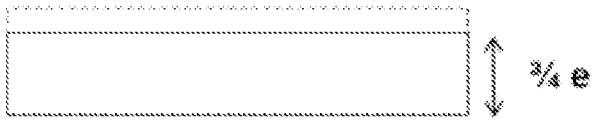
FIG. 3B machining for removing ¼ of the thickness, FIG. 3C second measurement.
Figure 3C:
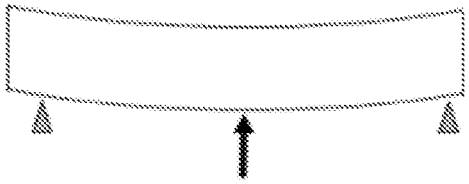
FIG. 3 shows the steps implemented for measuring differences in deflection.

For measurements of deflection, the bar is placed on two supports 390 mm apart (the supports are represented by triangles 1 in FIG. 3-A). A movement sensor (represented by an arrow 2 2 in FIG. 3A is used for measuring the deflection of the bar.

The steps are as follows:

An initial measurement of deflection of the bar is made (see FIG. 3A), which gives the values referenced Deflection L ini and Deflection LT ini expressed in mm.

The bar is next machined to remove ¼ of its thickness (see diagram in FIG. 3 B).

A second measurement is made (see FIG. 3C), which gives the values referenced Deflection L ¼ and Deflection LT ¼ expressed in mm.

The bar is machined once again to remove an additional ¼ of its thickness. Then only ½ of initial thickness remains.

A third measurement is made, which gives the values referenced Deflection L ½ and Deflection LT ½ expressed in mm.

In each machining step, the heating is limited to 10° C. so as to avoid any influence of the machining conditions on the deflection measurements made.

The differences in deflection between ¼ and initial and then between ½ and ¼ are set out in Table 3 below, for the L and LT directions. The difference in maximum deflection multiplied by the rolling-exit thickness is also set out.

TABLE 3

Deflections measured on machined bars

| Alloys | Rolling-exit thickness | Final thickness (mm) | Deflection differences (mm): Deflection L 1/4-Deflection L ini | Deflection L 1/2 - Deflection L 1/4 | Deflection LT 1/4-Deflection LT ini | Deflection LT 1/2-Deflection LT 1/4 | Maximum deflection difference * rolling-exit thickness |
|---|---|---|---|---|---|---|---|
| A | 25 | 20 | 0.205 | 0.177 | 0.127 | 0.038 | 5.13 |
| B | 25 | 20 | 0.115 | 0.043 | 0.08 | 0.009 | 2.88 |
| B | 30 | 25 | 0.057 | 0.004 | 0.025 | 0.041 | 1.71 |
| B | 35 | 30 | 0.002 | 0.058 | 0.036 | 0.067 | 2.35 |
| C | 30 | 25 | 0.012 | 0.021 | 0.022 | 0.064 | 1.92 |
| C | 25 | 30 | 0.024 | 0.031 | 0.032 | 0.043 | 1.51 |

With the reference alloy, the product of the maximum deflection difference in the directions L and LT multiplied by the rolling-exit thickness is greater than 5.1; whereas with the alloy according to the invention this product is always less than 3.

Figure 1B:
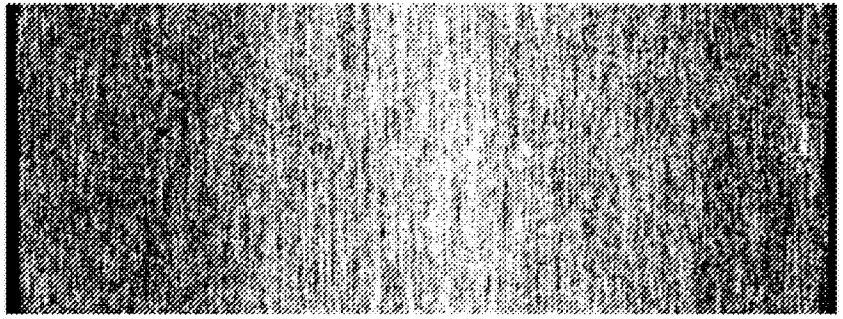

The granular structure was characterized for certain tests after hot rolling. The results are presented in FIG. 1. FIG. 1*a* shows the granular structure after anodic oxidation of the alloy A after hot rolling to the thickness 25 mm. FIG. 1*b* shows the granular structure after anodic oxidation of the alloy B after hot rolling to the thickness 25 mm. In FIG. 1*a*, a recrystallized zone is observed close to the surface while in FIG. 1*b* this zone is not observed, the granular structure is fibrous, i.e. non-recrystallized, throughout the thickness of the hot-rolled product.

The texture of the products was measured on samples of 50×50 mm in the plane L/LT so as to obtain a Taylor factor in the longitudinal direction. The results are presented in Table 4. For the products according to the invention, the ratio between the Taylor factor at $1/12^{th}$ of the thickness and at ½ thickness is significantly smaller than for the reference product.

TABLE 4

| Alloys | | Final thickness (mm) | Taylor factor at the position T/12 | Taylor factor at the position T/2 | Ratio of the Taylor factor T/12/T/2 |
|---|---|---|---|---|---|
| A | Y61803 | 20 | 1.12 | 0.99 | 1.13 |
| B | Y61781 | 20 | 1.12 | 1.05 | 1.07 |
| B | Y61779 | 25 | 1.07 | 1.08 | 0.99 |

Taylor factors measured

The invention claimed is:

1. A method for manufacturing an aluminum alloy plate with a final thickness of between 20 and 30 mm, wherein a) a rolling ingot is cast from aluminum alloy with the composition, as % by weight, Si: 0.7-1.3; Mg: 0.6-1.2; Mn: 0.85-1.0; Fe: 0.05-0.35; at least one element selected from Cr: 0.1-0.3 and Zr: 0.06-0.15; Ti<0.15; Cu<0.04; Zn<0.1; other elements <0.05 each and <0.15 in total, remainder aluminum, b) said rolling ingot is homogenized, c) said rolling ingot is rolled at a temperature of at least 340° C. and no more than 420° C. to obtain a plate, d) optionally heat treatment and/or cold rolling of the plate thus obtained is carried out, e) a solution heat treatment of the plate, optionally heat treated and/or cold rolled is carried out, and said plate is quenched, f) said plate thus solution heat treated and quenched is stress relieved by controlled stretching with a permanent elongation of 1 to 5%, g) aging of the plate thus stretched is carried out, h) optionally said plate thus aged is machined to obtain a plate with a final thickness of at least 20 mm;

wherein product of maximum deflection difference in directions L and LT multiplied by rolling-exit thickness is less than 4, differences in deflections considered for obtaining maximum value being firstly difference in deflection between deflection measured for a bar of dimensions 400 mm×30 mm×rolling-exit thickness and deflection measured for said bar after machining of ¼ of thickness thereof, and secondly difference in deflection between deflection measured for the previous bar and deflection measured for said previous bar after supplementary machining of ¼ of thickness thereof, all deflection measurements being made with the bar placed on two supports 390 mm apart and the deflections being expressed in mm, all measurements being made before optional final machining;

wherein the plate is a precision plate.

2. The method according to claim 1, wherein the Cr content is between 0.15 and 0.25% by weight and the Zr content is less than 0.05% by weight.

3. The method according to claim 1, wherein the Fe content is between 0.08 and 0.15% by weight.

4. The method according to claim 1, wherein the homogenizing temperature is between 515° C. and 545° C.

5. The method according to claim 1, wherein the hot-rolling temperature is maintained at at least 350° C. and the maximum rolling mill draft of passes during hot rolling is less than 50%.

6. The method according to claim 1, wherein the hot-rolling temperature is maintained at at least 350° C. and the maximum rolling mill draft of passes during hot rolling is less than 50%.

7. The method according to claim 1, wherein exit temperature of the hot rolling is no more than 410° C.

8. A plate with a final thickness of between 20 and 30 mm made from aluminum alloy with a composition, as % by weight, Si: 0.7-1.3; Mg: 0.6-1.2; Mn: 0.85-1.0; Fe: 0.05-0.35; at least one element selected from Cr: 0.1-0.3 and Zr: 0.06-0.15; Ti<0.15; Cu<0.04; Zn<0.1; other elements <0.05 each and <0.15 in total, remainder aluminum, obtained by:

a) a rolling ingot is cast from the aluminum alloy with the composition b) said rolling ingot is homogenized, c) said rolling ingot is rolled at a temperature of at least 340° C. and no more than 420° C. to obtain a plate, d) optionally heat treatment and/or cold rolling of the plate thus obtained is carried out, e) a solution heat treatment of the plate, optionally heat treated and/or cold rolled is carried out, and said plate is quenched, f) said plate thus solution heat treated and quenched is stress relieved by controlled stretching with a permanent elongation of 1 to 5%, g) aging of the plate thus stretched is carried out, h) optionally said plate thus aged is machined to obtain the plate with the final thickness of at least 20 mm;

wherein product of maximum deflection difference in directions L and LT multiplied by rolling-exit thickness is less than 4, differences in deflections considered for obtaining maximum value being firstly difference in deflection between deflection measured for a bar of dimensions 400 mm×30 mm×rolling-exit thickness and deflection measured for said bar after machining of ¼ of thickness thereof, and secondly difference in deflection between deflection measured for the previous bar and deflection measured for said previous bar after supplementary machining of ¼ of thickness thereof, all deflection measurements being made with the bar placed on two supports 390 mm apart and the deflections being expressed in mm, all measurements being made before optional final machining;

wherein the plate is a precision plate.

9. The plate according to claim 8, having a yield strength Rp0.2 (LT) of at least 240 MPa, and/or an ultimate tensile strength Rm (LT) of at least 280 MPa, and/or an elongation at rupture A % of at least 8%.

10. The plate according to claim 8, wherein the ratio between Taylor factor in longitudinal direction measured at 1/12th of the thickness and ½ of thickness is between 0.90 and 1.10, measurements being made before optional final machining.

11. The plate according to claim 8, wherein the Cr content is 0.15-0.25% by weight and/or the Zr content is 0.08-0.13% by weight.

12. The plate according to claim 8, wherein the Fe content is 0.08-0.15% by weight.

13. The plate according to claim 8, wherein the Mg content is 0.6-0.8% by weight.

14. The plate according to claim 8, wherein the Si content is 0.8-1.0% by weight.

15. The plate according to claim 8, wherein the final thickness is between 25 and 30 mm.

* * * * *